US007381046B2

(12) United States Patent
Kuo

(10) Patent No.: US 7,381,046 B2
(45) Date of Patent: Jun. 3, 2008

(54) LIPSTICK MAKING DEVICE

(76) Inventor: Fu Chin Kuo, No. 25, Avenue 99, Lane 274, Chong Jeng South Road, Yong Kang City, Tainan Hsien 71073 (TW)

( * ) Notice: Subject to any disclaimer, the term of this patent is extended or adjusted under 35 U.S.C. 154(b) by 51 days.

(21) Appl. No.: 11/476,969

(22) Filed: Jun. 27, 2006

(65) Prior Publication Data

US 2007/0295887 A1 Dec. 27, 2007

(51) Int. Cl.
*B29C 39/36* (2006.01)

(52) U.S. Cl. ..... 425/443; 249/117; 249/66.1; 249/68; 425/441; 425/451.4; 425/803; 425/DIG. 32

(58) Field of Classification Search ..... 425/440, 425/451.4, 576, 577, 803, DIG. 32, 443, 425/441; 249/127, 137, 142, 66.1, 68, 117; D28/85

See application file for complete search history.

(56) References Cited

U.S. PATENT DOCUMENTS

| | | | | | |
|---|---|---|---|---|---|
| 2,263,302 | A * | 11/1941 | Johnson | 425/507 |
| 2,564,624 | A * | 8/1951 | Hoos | 29/525 |
| 3,279,740 | A * | 10/1966 | Long | 249/181 |
| 3,333,740 | A * | 8/1967 | Waller | 222/182 |
| 3,947,209 | A | 3/1976 | Fox | 425/440 |
| 4,027,845 | A | 6/1977 | Putzer | 249/142 |
| 4,111,623 | A * | 9/1978 | Black | 425/129.1 |
| 4,571,171 | A * | 2/1986 | Blank et al. | 425/533 |
| 5,394,605 | A * | 3/1995 | Fattori et al. | 29/563 |
| 5,494,434 | A * | 2/1996 | Schwaiger et al. | 425/577 |
| 5,979,468 | A * | 11/1999 | Blake, III | 132/318 |
| 5,988,917 | A * | 11/1999 | Sheffler et al. | 401/78 |
| 6,012,914 | A * | 1/2000 | Loulourgas | 425/574 |
| 6,022,209 | A | 2/2000 | Kuo | 425/440 |
| 6,033,606 | A * | 3/2000 | Garza | 264/36.1 |
| 6,290,414 | B1 * | 9/2001 | Seebach et al. | 401/78 |
| 6,506,330 | B1 * | 1/2003 | Schweigert et al. | 264/318 |
| 6,840,756 | B2 * | 1/2005 | Coel et al. | 425/556 |
| 7,008,131 | B2 * | 3/2006 | Kagevarna et al. | 401/30 |
| 7,128,567 | B2 * | 10/2006 | Avalle | 425/440 |
| 7,232,301 | B2 * | 6/2007 | Avalle | 425/110 |
| 2002/0085874 | A1 * | 7/2002 | Kagevarna et al. | 401/30 |
| 2007/0023964 | A1 * | 2/2007 | Gilg | 264/313 |
| 2007/0098479 | A1 * | 5/2007 | Kim | 401/129 |

FOREIGN PATENT DOCUMENTS

| | | | |
|---|---|---|---|
| EP | 369509 | A1 * | 5/1990 |
| EP | 578179 | A1 * | 1/1994 |

* cited by examiner

*Primary Examiner*—James Mackey
*Assistant Examiner*—Dimple N Bodawala
(74) *Attorney, Agent, or Firm*—Charles E. Baxley, Esq.

(57) ABSTRACT

A lipstick making device includes an elastic mold device having a mold cavity for filling and molding a lipstick element, three or more curved mold pieces movably disposed above the elastic mold device for forming a hole in the mold pieces when the curved mold pieces are moved radially inward and toward each other, and for receiving the lipstick material to form a root portion of the lipstick element. The root portion of the lipstick element may be exposed when the curved mold pieces are moved away from each other for allowing the slide of the lipstick housing to be easily and readily engaged onto the exposed root portion of the lipstick element.

13 Claims, 9 Drawing Sheets

LIPSTICK MAKING DEVICE

BACKGROUND OF THE INVENTION

1. Field of the Invention

The present invention relates to a lipstick making device, and more particularly to a lipstick making device including a structure for stably holding a lipstick element and for allowing a slide of a lipstick housing to be effectively engaged onto the lipstick element and for preventing the lipstick element from being damaged inadvertently.

2. Description of the Prior Art

Typical lipstick making devices comprise an elastic candle mold having a number of circumferentially spaced metal plates movable outward simultaneously for allowing the elastic candle mold to be expanded and for allowing the molded lipstick element to be removed from the elastic candle mold.

For example, U.S. Pat. No. 3,947,209 to Fox discloses one of the typical mechanical expanders for elastic candle molds including a number of circumferentially spaced metal plates embedded in the side walls of the mold and to be pulled radially outward simultaneously by such as individual pull cables, for allowing the elastic candle mold to be expanded and for removing the molded lipstick element.

However, the elastic candle molds include a mold cavity having a height or depth equals to that of the lipstick element to be molded or to be made, such that the molded lipstick element should first be removed or disengaged from the elastic candle molds before a slide of a lipstick housing may be engaged onto the lipstick element, and such that the soft lipstick element may have a good chance to be damaged or distorted inadvertently while being removed or disengaged from the elastic candle molds and/or while being engaged with the slide of the lipstick housing.

U.S. Pat. No. 4,027,845 to Putzer discloses another typical flexible mold having a rigid encapsulated mandrel for molding the soft lipstick element onto the rigid encapsulated mandrel within a cylindrical portion of the typical flexible mold.

However, similarly, the mold cavity of the typical flexible mold also includes a height or depth equals to that of the lipstick element to be molded or to be made, such that the molded lipstick element also should first be removed or disengaged from the flexible molds before a slide of a lipstick housing may be engaged onto the lipstick element, and such that the soft lipstick element also may have a good chance to be damaged or distorted inadvertently while being removed or disengaged from the flexible molds and/or while being engaged with the slide of the lipstick housing.

U.S. Pat. No. 6,022,209 to Kuo discloses a further typical lipstick making device including a flexible and expandable mold piece having a mold cavity for molding or making the soft lipstick element, and a seat disposed onto the expandable mold piece and having an opening formed therein for forming an additional root portion of the soft lipstick element and for allowing the root portion of the lipstick element to be extended out of the expandable mold piece when the seat is removed or disengaged from the expandable mold piece, and thus for allowing a slide of a lipstick housing to be easily engaged onto the root portion of the lipstick element when or after the seat is removed or disengaged from the expandable mold piece.

However, the seat includes a rigid structure and may not be expanded radially and outwardly relative to the root portion of the lipstick element, such that a complicated facility or mechanism is required for moving or disengaging the seat from the expandable mold piece.

The present invention has arisen to mitigate and/or obviate the afore-described disadvantages of the conventional lipstick making devices.

SUMMARY OF THE INVENTION

The primary objective of the present invention is to provide a lipstick making device including a structure for stably holding a lipstick element and for allowing a slide of a lipstick housing to be effectively engaged onto the lipstick element and for preventing the lipstick element from being damaged inadvertently.

In accordance with one aspect of the invention, there is provided a lipstick making device comprising an elastic mold device including a mold cavity formed therein for filling a lipstick material to form a lipstick element, at least three curved mold pieces movably disposed and located above the elastic mold device, for forming a hole in the mold pieces when the curved mold pieces are moved radially inward and toward each other, and for receiving the lipstick material to form a root portion of the lipstick element, and a moving device for moving the curved mold pieces away from each other to expose the root portion of the lipstick element.

The sliding members are movably disposed and located above the elastic mold device for attaching and supporting the curved mold pieces respectively.

The sliding members each include a projection extended therefrom, the moving device includes a casing rotatably engaged onto the sliding members and having at least three inclined passageways formed therein for slidably receiving the projections of the sliding members and for forcing and guiding the sliding members to move radially outward and away from each other by rotating the casing relative to the sliding members.

The casing includes an opening formed therein for slidably receiving the curved mold pieces of the sliding members. A housing may further be provided and includes a chamber formed therein for receiving the elastic mold device, the casing is attached on the housing.

A seat may further be provided and disposed above the elastic mold device and includes at least three radially extended slots formed therein for slidably receiving the sliding members therein and for guiding the sliding members to move radially inward and outward relative to the seat.

An expanding device may further be provided for expanding the elastic mold device. The expanding device includes a housing having a chamber formed therein for receiving the elastic mold device.

Three or more followers may further be provided and slidably received in the housing and coupled to the elastic mold device for expanding the elastic mold device when the followers are moved relative to the housing.

The housing includes at least three radially extended channels formed therein and communicating with the chamber of the housing for slidably receiving the followers and for guiding the followers to move toward or away from the elastic mold device.

The housing includes at least one guide passage formed therein and communicating with the radially extended channels thereof, and the followers include an outwardly extended protrusion slidably received in the guide passage of the housing for guiding the followers to move toward or away from the elastic mold device.

The elastic mold device includes at least three plates secured thereto and coupled to the followers for expanding the elastic mold device. A rotating device may further be provided for rotating the rotary member relative to the housing.

A rotary member may further be provided and rotatably attached to the housing and coupled to the followers for moving the followers relative to the housing. The rotary member includes at least three inclined grooves formed therein, and the followers each includes a pin extended therefrom and slidably engaged into the of the inclined grooves of the rotary member for moving the followers relative to the housing to expand the elastic mold device when the rotary member is rotated relative to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
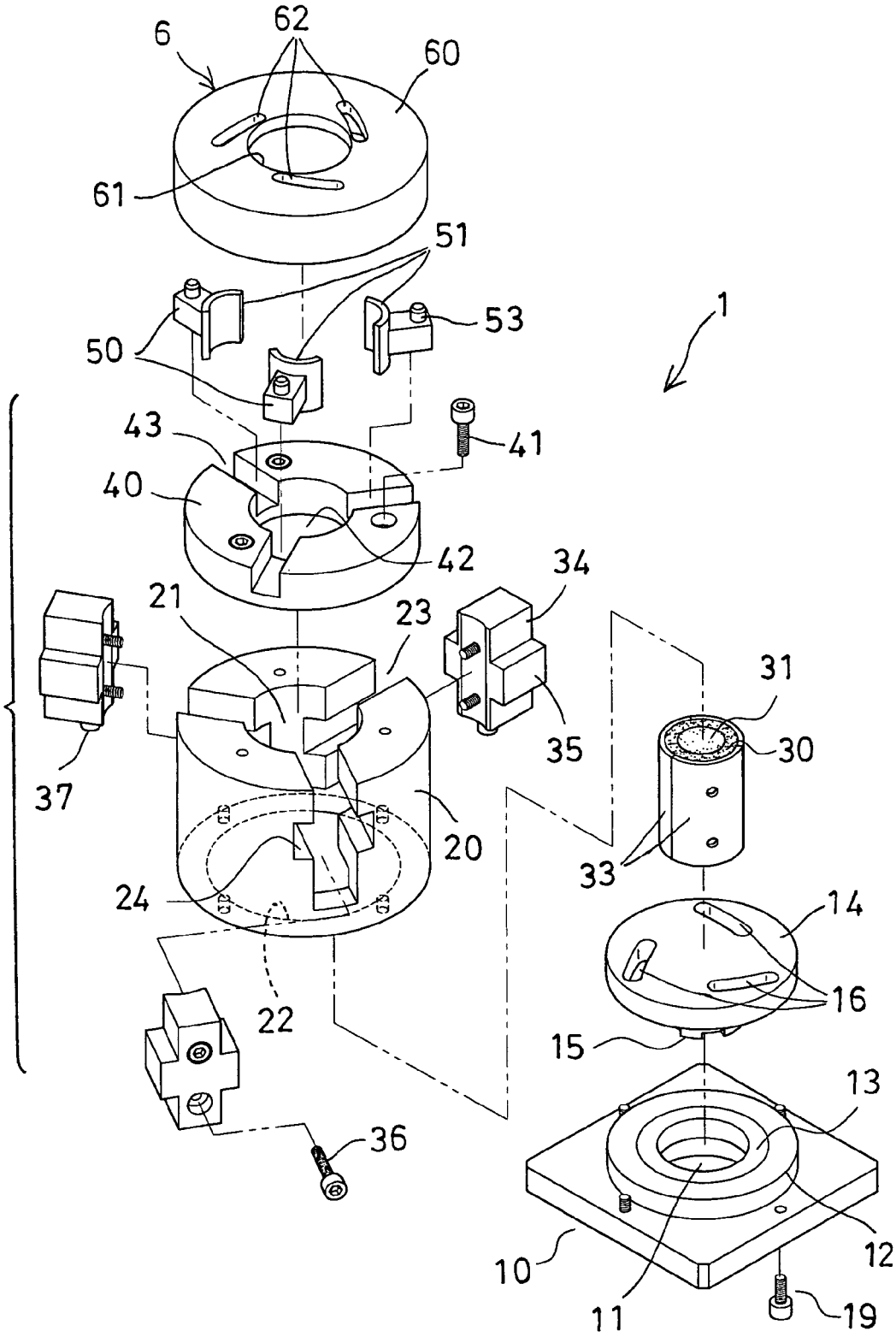
FIG. 1 is an exploded view of a lipstick making device in accordance with the present invention.

Referring to the drawings, and initially to FIGS. 1-4, a lipstick making device 1 in accordance with the present invention comprises a base support 10 including a compartment 11 formed in such as the center portion thereof, and including a peripheral bulge 12 extended upwardly therefrom and located around the compartment 11 of the base support 10, and including a peripheral bearing device 13 engaged in the peripheral bulge 12. A rotary member 14 includes a spindle 15 extended downwardly therefrom and engaged into the compartment 11 of the base support 10 and engaged with the bearing device 13 for allowing the rotary member 14 to be rotatably supported on the base support 10.

Figure 3:
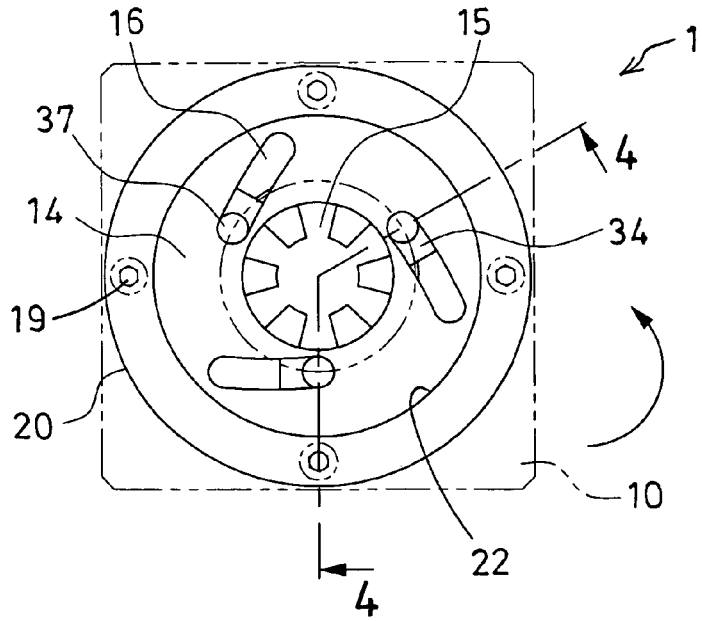
FIG. 3 is a bottom plan schematic view as seen from the bottom portion of the lipstick making device as shown in FIG. 4, in which a base support has been removed.
Figure 4:
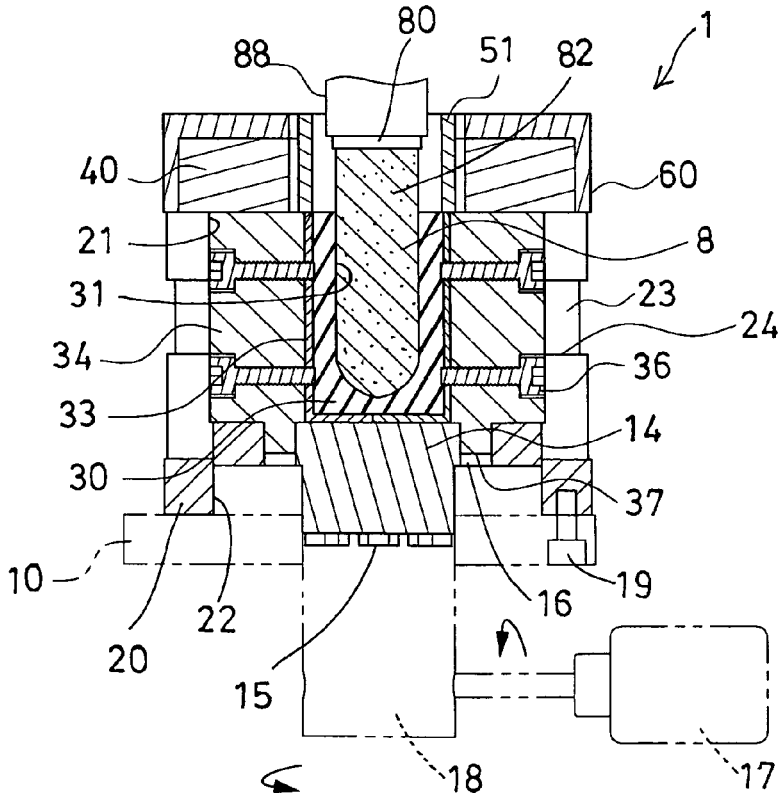
FIG. 4 is a cross sectional view of the lipstick making device, taken along lines 4-4 of FIG. 3.
Figure 5:
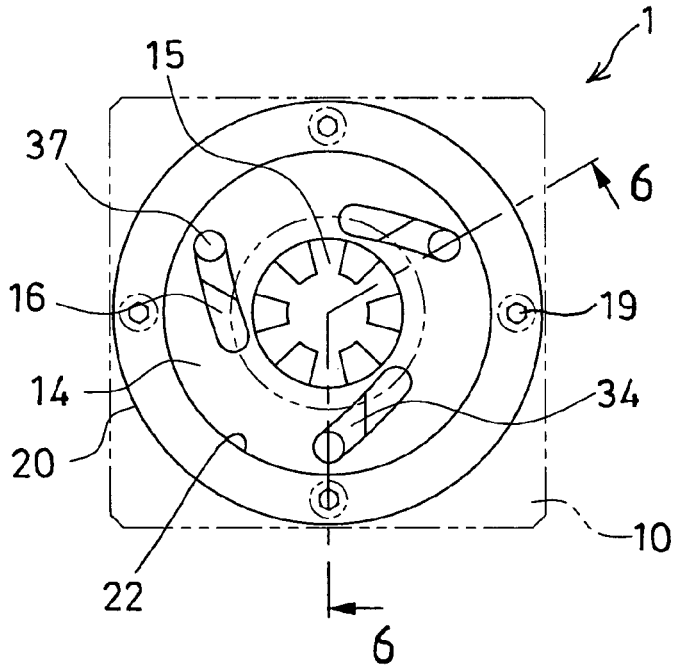
FIG. 5 is a bottom plan schematic view similar to FIG. 3, illustrating the operation of the lipstick making device.
Figure 6:
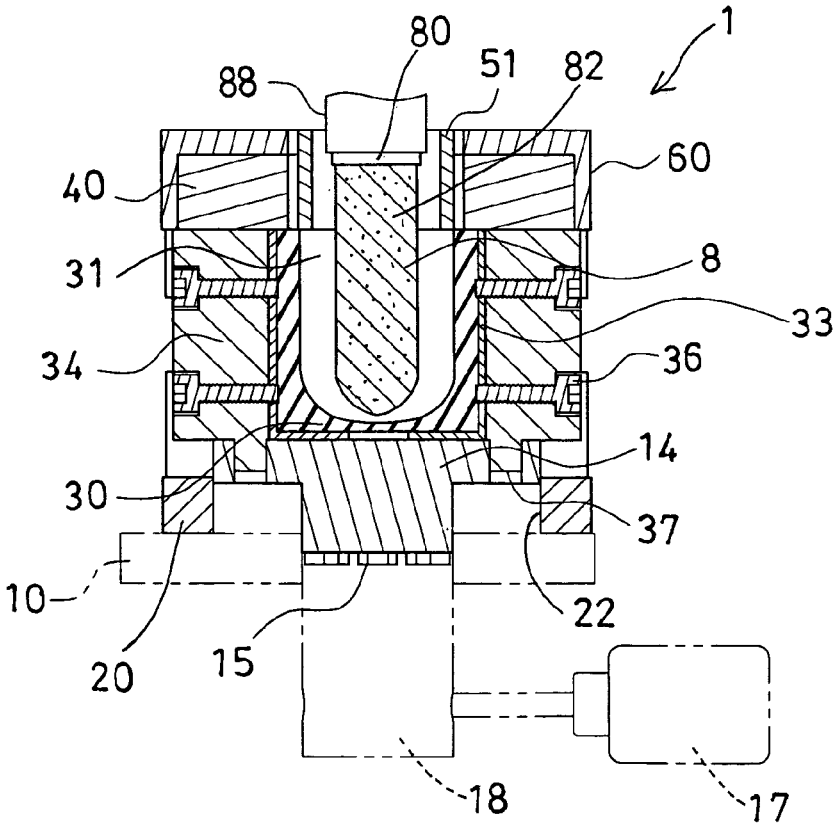
FIG. 6 is a cross sectional view of the lipstick making device, taken along lines 6-6 of FIG. 5.

The rotary member 14 includes a number of, such as three or more inclined grooves 16 formed therein, such as inclined from a radially inward portion or inner peripheral portion toward a radially outward portion or outer peripheral portion, best shown in FIGS. 1, 3, 5, and the inclined grooves 16 are preferably angularly and equally spaced away from each other. As shown in FIGS. 4 and 6, a driving device 17, such as a motor 17 may further be provided and coupled to the rotary member 14, particularly the spindle 15 of the rotary member 14 with a coupling device 18, such as a sprocket-and-chain, a pulley-and-belt, or a gearing coupling device 18, for allowing the rotary member 14 to be rotated or driven by the motor driving device 17.

An outer housing 20 includes a chamber 21 formed therein, such as formed in the upper portion thereof for receiving an elastic mold device 30 therein, and includes an enlarged space 22 formed therein, such as formed in the bottom portion thereof for receiving the rotary member 14 and/or the peripheral bulge 12 of the base support 10, and thus for anchoring or positioning the housing 20 on the base support 10, and thus for rotatably attaching and retaining the rotary member 14 within the housing 20 and/or between the housing 20 and the base support 10, and for allowing the rotary member 14 to be rotated relative to the housing 20 and the base support 10. The housing 20 may further be solidly secured to the base support 10 with one or more fasteners 19 (FIGS. 1, 3, 4).

The elastic mold device 30 includes a mold cavity 31 formed therein for filling or receiving a lipstick material and thus for molding and forming a lipstick element 8 (FIGS. 4, 6, 8, 10, 11) which will then be engaged into a typical slide 80 of a lipstick housing 88, or the slide 80 of the lipstick housing 88 will then be engaged onto the lipstick element 8 (FIGS. 4, 6, 11, 12) for allowing the lipstick element 8 to be moved inward and outward of the lipstick housing 88 by the slide 80, and for storing and exposing the lipstick element 8. The molded lipstick element 8 may be retained or supported by the elastic mold device 30 when the slide 80 of the lipstick housing 88 is engaged onto the lipstick element 8.

Figure 14:
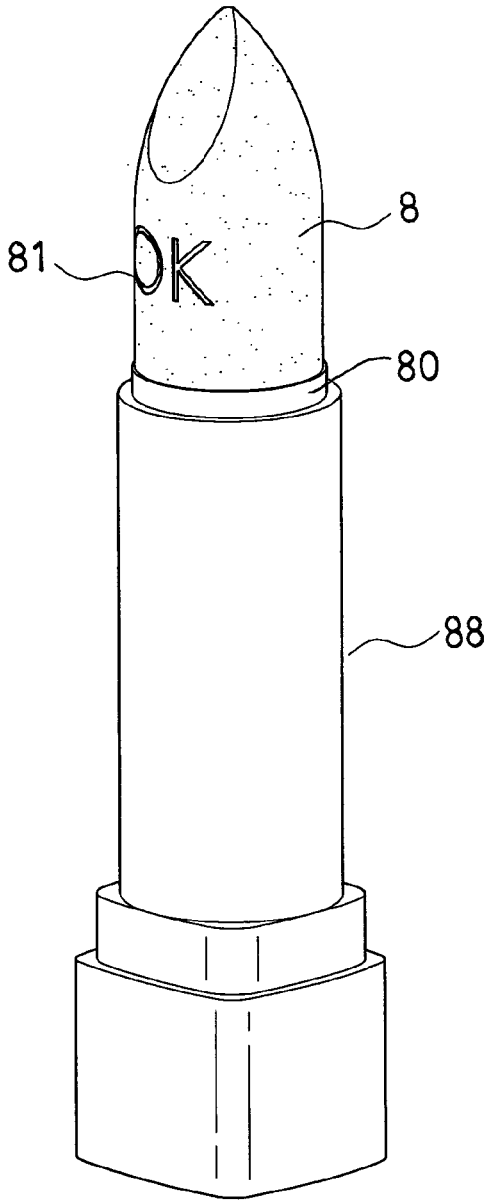
FIG. 14 is a perspective view of a lipstick to be made with the lipstick making device as shown in FIG. 13.
Figure 13:
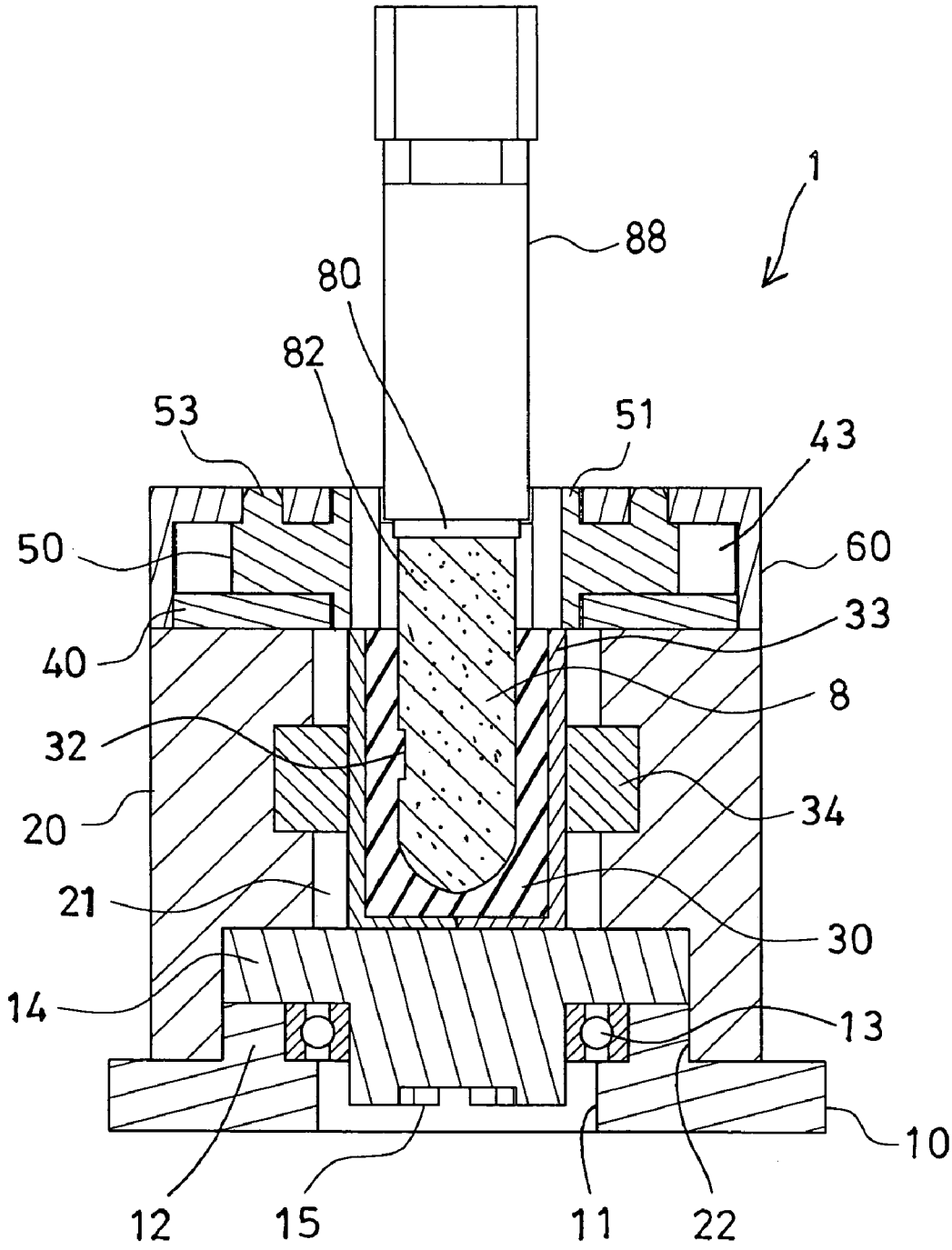
FIG. 13 is a cross sectional view similar to FIGS. 6 and 7, illustrating the other arrangement of the lipstick making device.

The elastic mold device 30 may include one or more concave or convex patterns 32 provided therein and communicating with or extended into the mold cavity 31 thereof (FIG. 13) for transferring or forming the corresponding patterns 81 onto the lipstick element 8 (FIG. 14). The elastic mold device 30 includes a size or volume or outer diameter smaller than the inner diameter of the chamber 21 of the housing 20 (FIGS. 8, 10, 11) for allowing the elastic mold device 30 to be suitably expanded relative to the housing 20 (FIG. 6). For example, the elastic mold device 30 may include a number of, such as three or more plates 33 attached or secured to the outer peripheral portion thereof for suitably expanding the elastic mold device 30.

The housing 20 may further include a number of, such as three or more radially extended channels 23 formed therein and communicating with the chamber 21 of the housing 20, and one or more guide passages 24 formed therein and communicating with each of the channels 23 thereof, a number of, such as three or more followers 34 are slidably received in the channels 23 of the housing 20 respectively and each include one or more protrusions 35 extended outwardly therefrom and slidably received in the guide passages 24 of the housing 20 respectively, for smoothly guiding the followers 34 to move radially inward and outward relative to the housing 20 or to move toward or away from the elastic mold device 30. The followers 34 may be secured to the plates 33 with one or more fasteners 36 for suitably expanding the elastic mold device 30.

The followers 34 each include a pin 37 extended downwardly therefrom and slidably engaged into the inclined grooves 16 of the rotary member 14 respectively for allowing the followers 34 to be forced and guided to move radially inward and outward along or relative to the guide passages 24 of the housing 20 respectively (FIGS. 3, 5) by the rotary member 14 and/or the motor driving device 17, and thus for suitably expanding the elastic mold device 30 (FIG. 6) relative to the housing 20. In the present invention, the molded lipstick element 8 may suitably be retained or supported by the elastic mold device 30 when the slide 80 of the lipstick housing 88 is engaged onto the lipstick element 8, before the elastic mold device 30 is expanded.

The lipstick making device 1 further includes a seat 40 (FIGS. 1, 2, 8, 10, 11) disposed on the housing 20 and secured to the housing 20 with such as fasteners 41, and having a bore 42 formed therein, in which the bore 42 of the seat 40 includes an inner diameter substantially, but not necessarily be equals to the inner diameter of the chamber 21 of the housing 20, and the seat 40 further includes a number of, such as three or more radially extended slots 43 formed therein and communicating with the bore 42 of the seat 40, and each for slidably receiving a sliding member 50 therein and for guiding the sliding member 50 to move radially inward and outward relative to the seat 40 and the housing 20.

Figure 7:
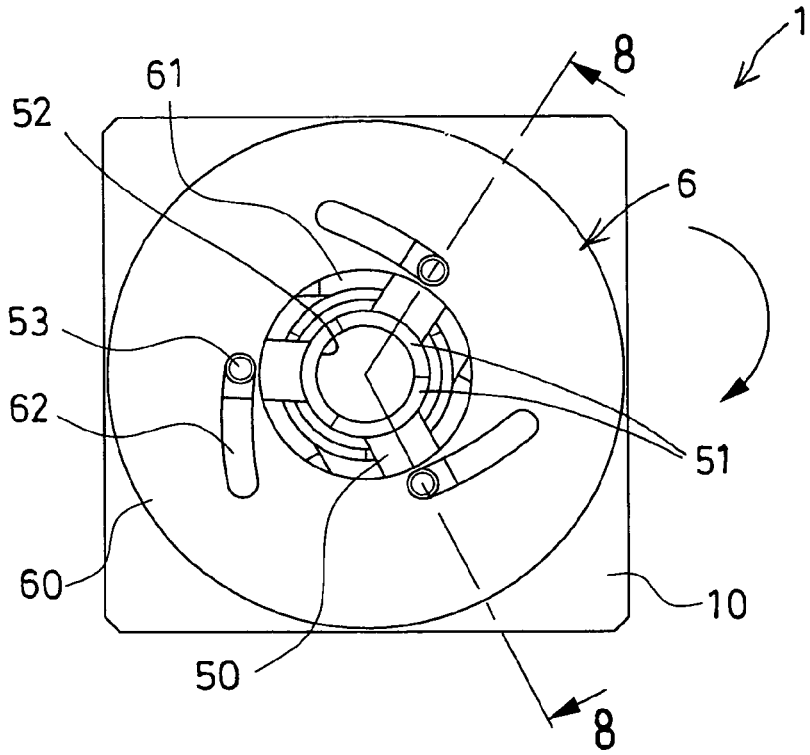
FIG. 7 is a top plan schematic view of the lipstick making device.
Figure 8:
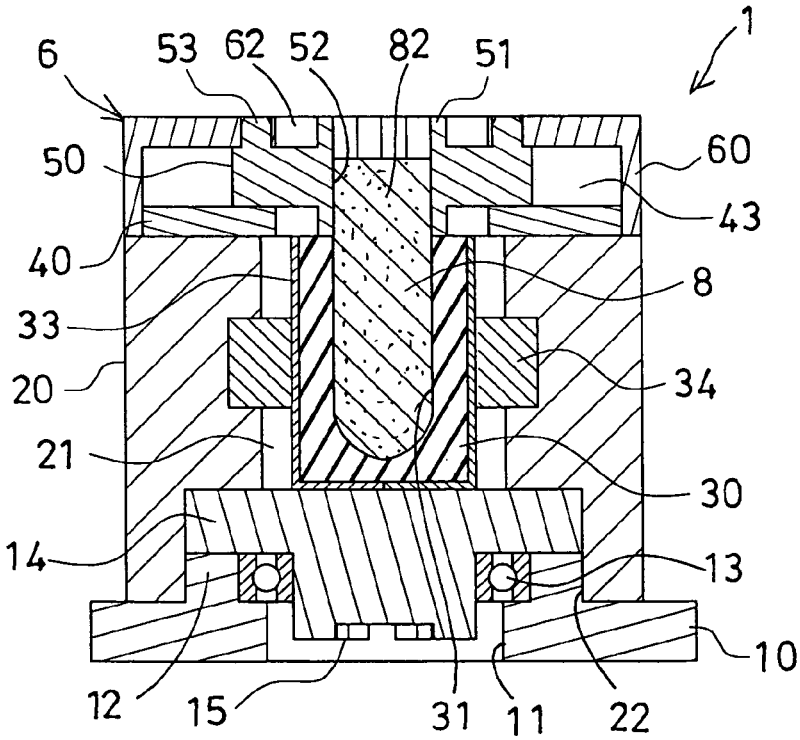
FIG. 8 is a cross sectional view of the lipstick making device, taken along lines 8-8 of FIG. 7.
Figure 10:
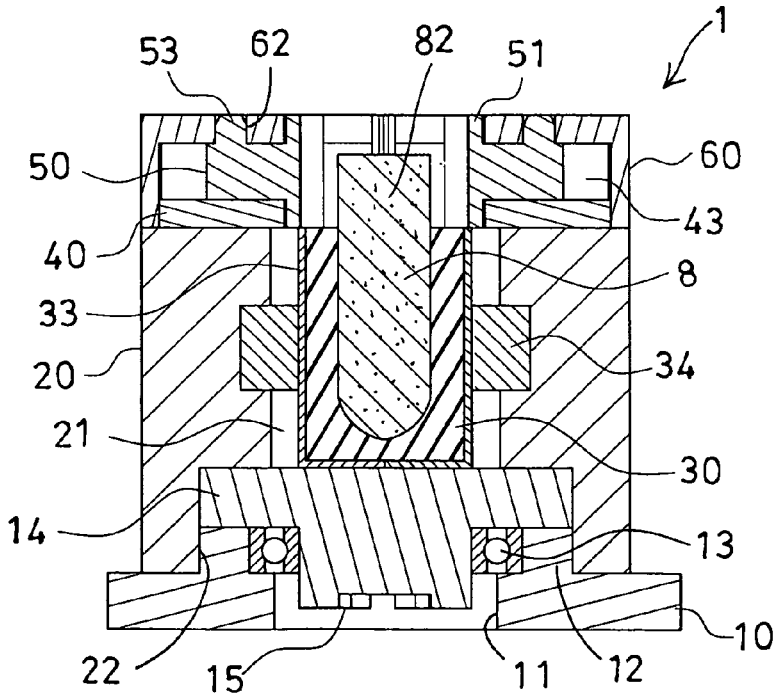
FIG. 10 is a cross sectional view of the lipstick making device, taken along lines 10-10 of FIG. 9.
Figure 11:
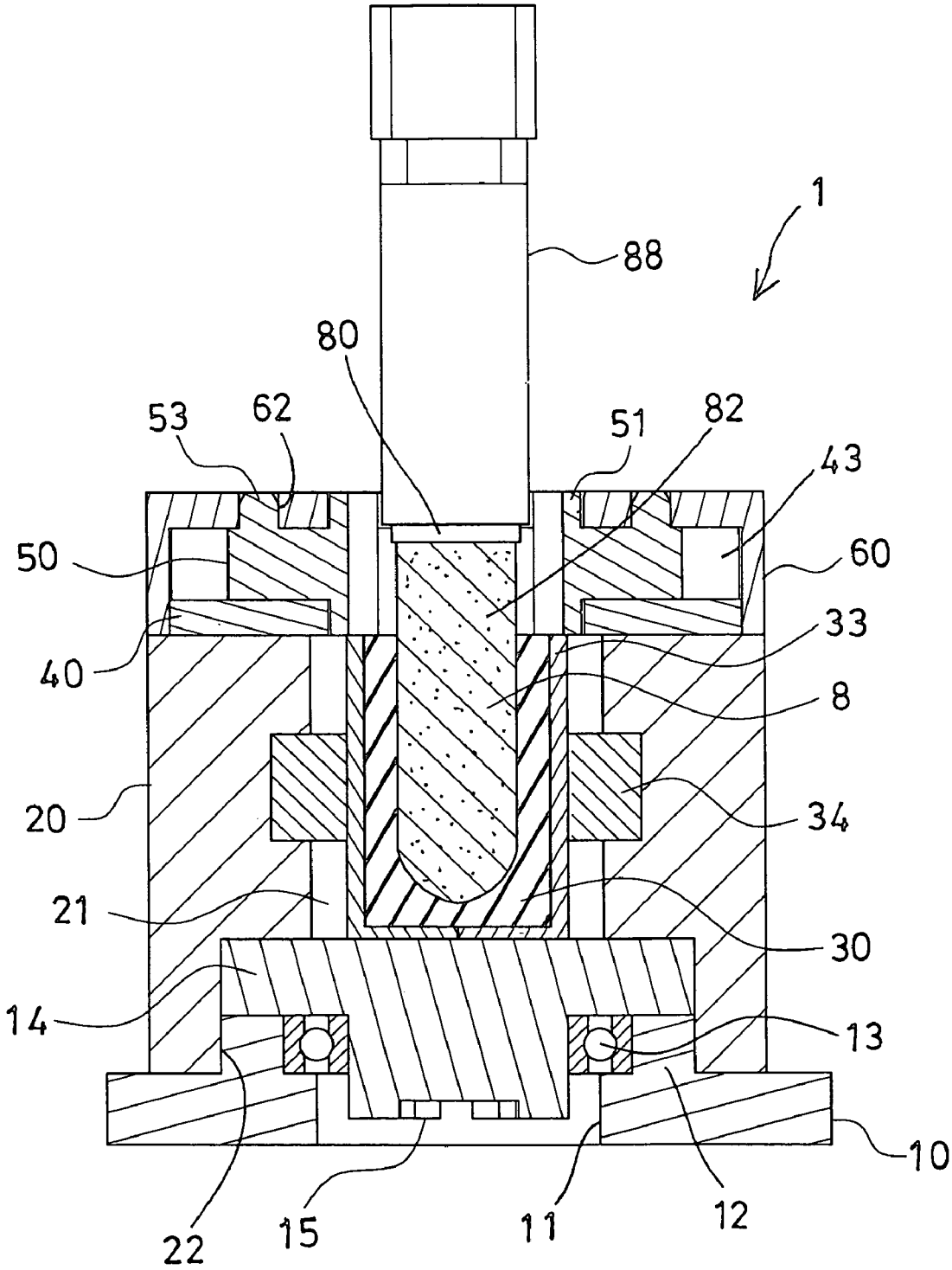
FIG. 11 is a cross sectional view similar to FIG. 10, illustrating an engagement of a slide of a lipstick housing onto a lipstick element molded by the lipstick making device.

A curved mold piece 51 is formed or attached or provided on each of the sliding members 50, and movably disposed or located above the elastic mold device 30, and the curved mold pieces 51 include a curvature for forming a circular hole 52 therein (FIGS. 7, 8) when the curved mold pieces 51 are moved radially inward and toward each other, in which the circular hole 52 of the curved mold pieces 51 includes an inner diameter substantially equals to the inner diameter of the mold cavity 31 of the elastic mold device 30, best shown in FIG. 8 for filling or receiving the lipstick material and thus for molding and forming a root portion 82 of the lipstick element 8 (FIGS. 4, 6, 8, 10, 11), in which the root portion 82 of the lipstick element 8 is extended or protruded out of the elastic mold device 30, best shown in FIGS. 4, 10, 11.

The slide 80 of the lipstick housing 88 may then be easily attached or engaged onto the root portion 82 of the lipstick element 8 (FIGS. 4, 11) when the curved mold pieces 51 are moved radially outward and away from each other. The sliding members 50 each include a projection 53 extended upwardly therefrom. A moving means or device 6 for moving the mold pieces 51 or the sliding members 50 includes a casing 60 rotatably engaged or attached onto the seat 40 and/or the housing 20 and/or the mold pieces 51 or the sliding members 50, and the casing 60 may be rotatably attached or secured to the seat 40 and the housing 20 with such as clamping or retaining rings (not shown), or may be loosely attached to and disengaged from the seat 40 and/or the housing 20. The casing 60 includes an opening 61 formed therein and having an inner diameter substantially, but not necessarily be equals to the inner diameter of the bore 42 of the seat 40 or the chamber 21 of the housing 20, for slidably receiving the mold pieces 51 of the sliding members 50.

The casing 60 further includes a number of, such as three or more inclined passageways 62 formed therein, such as inclined from a radially inward portion or inner peripheral portion toward a radially outward portion or outer peripheral portion, best shown in FIGS. 1, 2, 7, 9 and the inclined passageways 62 are preferably angularly and equally spaced away from each other for slidably receiving the projections 53 of the sliding members 50 respectively, and for forcing and guiding the sliding members 50 to move radially inward and outward along or relative to the radially extended slots 43 of the seat 40 respectively (FIGS. 7, 9) by rotating the casing 60 relative to the seat 40 and the housing 20.

Figure 2:
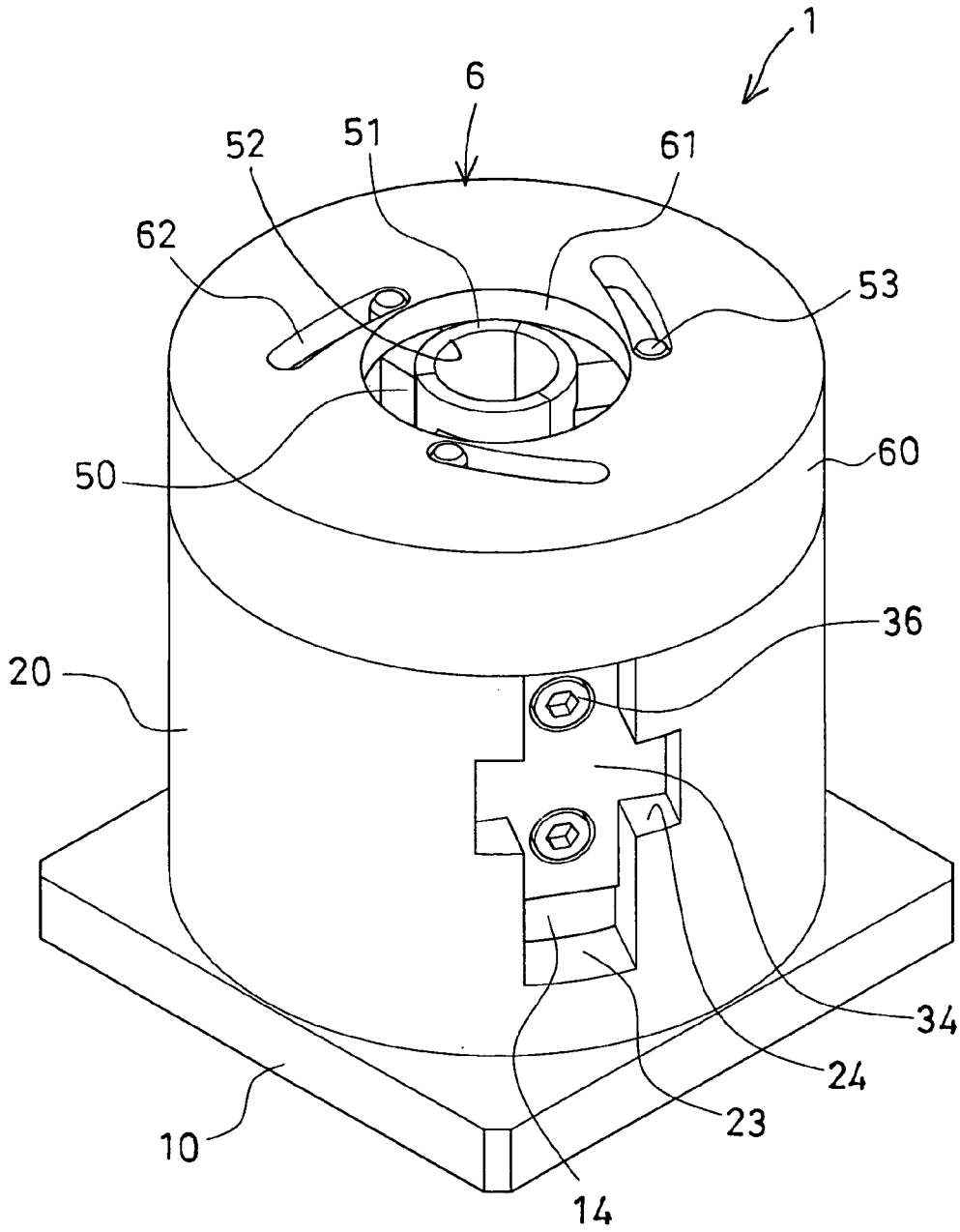
FIG. 2 is a perspective view of the lipstick making device.
Figure 9:
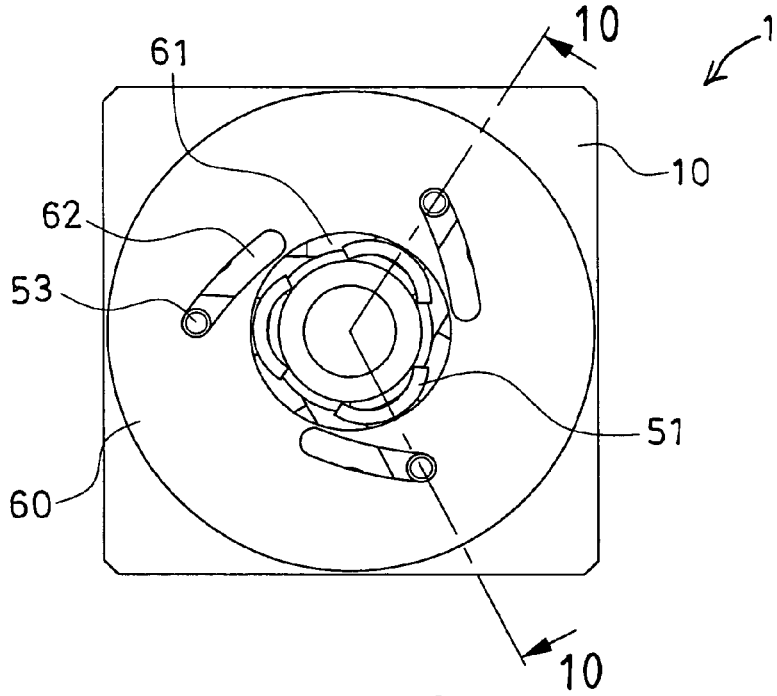
FIG. 9 is a top plan schematic view similar to FIG. 7, illustrating the operation of the lipstick making device.

In operation, as shown in FIGS. 2 and 7-8, the curved mold pieces 51 are moved radially inward and toward each other to form the circular hole 52 in the mold pieces 51 of the sliding members 50, and the lipstick material may then be filled or received into the circular hole 52 of the mold pieces 51 of the sliding members 50 and the mold cavity 31 of the elastic mold device 30 in order to mold and form the lipstick element 8. After the molded lipstick element 8 has been formed, the curved mold pieces 51 may then be moved radially outward and away from each other by rotating the casing 60 relative to the seat 40 and the housing 20 as shown in FIGS. 9-11, for allowing the root portion 82 of the lipstick element 8 to be exposed or extended or protruded out of the elastic mold device 30.

Figure 12:
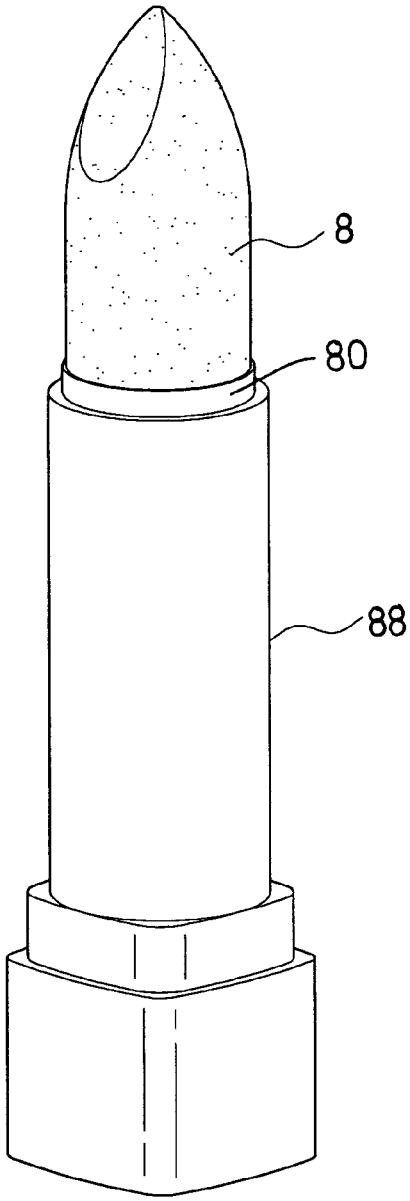
FIG. 12 is a perspective view of a lipstick to be made with the lipstick making device.

After or when the curved mold pieces 51 have been moved radially outward and away from each other and when the root portion 82 of the lipstick element 8 has been extended or protruded out of the elastic mold device 30, the slide 80 of the lipstick housing 88 may then be easily and readily engaged onto the root portion 82 of the lipstick element 8, best shown in FIG. 11, for allowing the lipstick element 8 to be relatively attached or engaged into the slide 80 of the lipstick housing 88, and for forming the lipstick as shown in FIG. 12 or 14. It is to be noted that the curved mold pieces 51 may be easily moved radially outward and away from each other by rotating the casing 60 relative to the seat 40 and the housing 20 to allow the root portion 82 of the lipstick element 8 to be exposed and thus to allow the slide 80 of the lipstick housing 88 to be easily and readily engaged onto the root portion 82 of the lipstick element 8. At this moment, the molded lipstick element 8 may be safely retained or supported by the elastic mold device 30 when the slide 80 of the lipstick housing 88 is engaged onto the lipstick element 8.

Accordingly, the lipstick making device in accordance with the present invention includes a structure for stably holding a lipstick element and for allowing the slide of the lipstick housing to be effectively engaged onto the lipstick element and for preventing the lipstick element from being damaged inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lipstick making device comprising:

an elastic mold device including a mold cavity formed therein for filling a lipstick material to form a lipstick element, at least three curved mold pieces movably disposed and located above said elastic mold device, for forming a hole in said mold pieces when said at least three curved mold pieces are moved radially inward and toward each other, and for receiving the lipstick material to form a root portion of the lipstick element, at least three sliding members movably disposed and located above said elastic mold device for attaching and supporting said at least three curved mold pieces respectively, said at least three sliding members each including a projection extended therefrom, and means for moving said at least three curved mold pieces away from each other to expose the root portion of the lipstick element, said moving means including a casing rotatably engaged onto said at least three sliding members and having at least three inclined passageways formed therein for slidably receiving said projections of said at least three sliding members and for forcing and guiding said at least three sliding members to move radially outward and away from each other by rotating said casing relative to said at least three sliding members.

2. The lipstick making device as claimed in claim 1, wherein said casing includes an opening formed therein for slidably receiving said at least three curved mold pieces of said at least three sliding members.

3. The lipstick making device as claimed in claim 1, wherein a housing is further provided and includes a chamber formed therein for receiving said elastic mold device.

4. The lipstick making device as claimed in claim 1, wherein a seat is disposed above said elastic mold device and includes at least three radially extended slots formed therein for slidably receiving said at least three sliding members therein and for guiding said at least three sliding members to move radially inward and outward relative to said seat.

5. The lipstick making device as claimed in claim 1 further comprising means for expanding said elastic mold device.

6. The lipstick making device as claimed in claim 5, wherein said expanding means includes a housing having a chamber formed therein for receiving said elastic mold device.

7. The lipstick making device as claimed in claim 6, wherein at least three followers are slidably received in said housing and coupled to said elastic mold device for expanding said elastic mold device when said at least three followers are moved relative to said housing.

8. The lipstick making device as claimed in claim 7, wherein said housing includes at least three radially extended channels formed therein and communicating with said chamber of said housing for slidably receiving said at least three followers and for guiding said at least three followers to move toward or away from said elastic mold device.

9. The lipstick making device as claimed in claim 8, wherein said housing includes at least one guide passage formed therein and communicating with said at least three radially extended channels thereof, and said at least three followers include an outwardly extended protrusion slidably received in said at least one guide passage of said housing for guiding said at least three followers to move toward or away from said elastic mold device.

10. The lipstick making device as claimed in claim 7, wherein said elastic mold device includes at least three plates secured thereto and coupled to said at least three followers for expanding said elastic mold device.

11. The lipstick making device as claimed in claim 1 further comprising means for rotating said rotary member relative to said housing.

12. A lipstick making device comprising:

an elastic mold device including a mold cavity formed therein for filling a lipstick material to form a lipstick element, at least three curved mold pieces movably disposed and located above said elastic mold device, for forming a hole in said mold pieces when said at least three curved mold pieces are moved radially inward and toward each other, and for receiving the lipstick material to form a root portion of the lipstick element, means for moving said at least three curved mold pieces away from each other to expose the root portion of the lipstick element, and means for expanding said elastic mold device, said expanding means including a housing having a chamber formed therein for receiving said elastic mold device, at least three followers slidably received in said housing and coupled to said elastic mold device for expanding said elastic mold device when said at least three followers are moved relative to said housing, and a rotary member rotatably attached to said housing and coupled to said at least three followers for moving said at least three followers relative to said housing.

13. The lipstick making device as claimed in claim 12, wherein said rotary member includes at least three inclined grooves formed therein, and said at least three followers each includes a pin extended therefrom and slidably engaged into said at least three of said at least three inclined grooves of said rotary member for moving said at least three followers relative to said housing to expand said elastic mold device when said rotary member is rotated relative to said housing.

* * * * *